United States Patent [19]

Ohta et al.

[11] 4,392,926

[45] Jul. 12, 1983

[54] PROCESS AND APPARATUS FOR PRODUCTION OF ALUMINUM

[75] Inventors: Teruto Ohta; Yoshio Kinoshita, both of Chiba, Japan

[73] Assignee: Showa Aluminum Industries K.K., Tokyo, Japan

[21] Appl. No.: 265,347

[22] Filed: May 19, 1981

[30] Foreign Application Priority Data

May 30, 1980 [JP] Japan ..... 55-71549
Jul. 4, 1980 [JP] Japan ..... 55-90557

[51] Int. Cl.[3] ..... C25C 3/06; C25C 3/08; C25C 3/14

[52] U.S. Cl. ..... 204/67; 204/246

[58] Field of Search ..... 204/67, 245, 246

[56] References Cited

U.S. PATENT DOCUMENTS 2,713,024 7/1955 Mantovanello ..... 204/67
3,135,672 6/1964 Hirakawa et al. ..... 204/246
3,551,308 12/1970 Capitaine et al. ..... 204/67
4,035,251 7/1977 Shiver et al. ..... 204/67

FOREIGN PATENT DOCUMENTS 138752 12/1960 U.S.S.R. ..... 204/67
537128 12/1976 U.S.S.R. ..... 204/67
623909 9/1978 U.S.S.R. ..... 204/246

*Primary Examiner*—Howard S. Williams
*Attorney, Agent, or Firm*—McAulay, Fields, Fisher, Goldstein & Nissen

[57] ABSTRACT

In the production of aluminum by electrolytically reducing alumina dissolved in a fused fluoride salt mainly composed of cryolite, the present invention aims to reduce the cell voltage and/or to increase the inter-electrode distance of an aluminum electrolytic cell with a self baking type electrode, thereby reducing the specific electric power consumption. The present invention also automatically eliminates the anode effect. This is achieved by introducing a gas to the lower surface of the carbon anode in contact with the electrolytic bath, via at least one aperture passing in an essentially vertical direction through the carbon anode.

15 Claims, 6 Drawing Figures

PROCESS AND APPARATUS FOR PRODUCTION OF ALUMINUM

BACKGROUND OF THE INVENTION

The present invention relates to the production of aluminum by electrolytic reduction of alumina dissolved in a fused fluoride salt-bath mainly composed of cryolite. More particularly, the present invention relates to a process for eliminating the anode effect by introducing a gas below the lower surface of a carbon anode and to a process for decreasing an inter-electrode voltage. In addition, the present invention relates to an apparatus for carrying out the process.

Terms used in the electrolytic production of aluminum and the present specification are first explained.

The specific electric power consumption (P) refers to the electric power consumed for the electrolytic production of a unit amount of aluminum.

The current efficiency ($\eta$) is expressed in terms of:

$$\frac{\text{actual production amount of aluminum}}{k \cdot I \cdot T} = \eta \qquad (1)$$

The specific electric power consumption (P) is expressed in terms of:

$$P = \frac{I \cdot t \cdot V}{k \cdot I \cdot t \cdot \eta} = \frac{V}{K \cdot \eta} \text{ (KWH/kg)}, \qquad (2)$$

wherein I is the intensity direct current (kA), t is time (Hrs) for passing the current, V is a cell voltage (V) and k is the electrochemical constant (kg/KAH).

The cell voltage (V) refers to a voltage applied to each electrolytic cell.

The self baking type carbon anode refers to an anode, wherein an unbaked carbonaceous paste is fed on the lower baked carbonaceous material and is baked or solidified during its downward displacement due to the heat generated by the ohmic resistance of the carbon anode and also due to the conduction of heat from an electrolyte having a high temperature, with the result that the unbaked carbonaceous paste is provided with the function of an anode.

The inter-electrode voltage refers to the voltage applied between the anode lower surface of the anode and the cathode surface which is the upper surface of the molten aluminum in the electrolytic cell.

The inter-electrode distance refers to the distance between the anode surface and the cathode surface of an electrolytic cell.

The inter-electrode voltage includes an alumina-decomposition voltage, an overvoltage and a voltage drop by the inter-electrode ohmic resistance.

The inter-electrode ohmic resistance and the voltage drop caused thereby involve two kinds. The first is the resistance of the electrolyte, hereinafter referred to as the electrolyte ohmic resistance, and the voltage drop caused by this ohmic resistance. Ohmic resistance of the electrolyte is inversely proportional to the specific electric conductivity of the electrolyte and is proportional to the inter-electrode distance. The second is a so-called gas-film resistance and the voltage drop due to this resistance. The gas-film resistance is closely related to the wettability of the carbon anode by the electrolyte, which is known.

The critical alumina concentration refers to the alumina concentration, which is gradually decreased, in accordance with the development of the electrolytic reaction, due to the decomposition of alumina dissolved in the fused fluoride salt, at which concentration the cell voltage is abruptly increased from the normal operation voltage, for example approximately 4 volts, to a voltage a few times higher, for example from 20 to 40 volts. In other words, the critical alumina concentration indicates the alumina concentration in the electrolyte which causes a critical increase of the gas-film resistance and the anode effect.

In the operation of an electrolytic cell of aluminum, it is very important to reduce the specific electric power consumption (P). Since, as described above, the specific electric power consumption (P) is proportional to the cell voltage (V) and is inversely proportional to the current efficiency ($\eta$), the electrolytic cell is desirably operated under the low cell voltage (V) and high current efficiency ($\eta$). In the routine operation of the electrolytic cell, in which the structure of the conductors of the cell and the composition range of the electrolyte cannot be optionally altered, the cell voltage (V) is controlled essentially by the inter-electrode voltage. That is, at a low inter-electrode voltage, the cell voltage becomes also low. The inter-electrode voltage is adjusted mainly by vertically displacing the carbon anode and thus changing the inter-electrode distance.

Incidentally, experience and theories in the electrolytic production of aluminum have indicated that: the inter-electrode distance influences the current efficiency; and, the current efficiency is decreased with the decrease in the inter-electrode distance. Accordingly, the specific electric power consumption (P) can be improved by an increase in the inter-electrode distance at a given inter-electrode voltage. The present invention is the result of research in an attempt to achieve an increase in the inter-electrode distance at a given inter-electrode voltage.

PRIOR ART

Recently, techniques of automatic operation of an aluminum electrolytic cell, including the control of the cell voltage and feed of alumina into the electrolyte, have been developed and have greatly contributed to the reduction of the labor required and the electric power consumption. From the view point of reduction of labor required and the electric power consumption, the techniques of eliminating the anode effect are desirably improved, so that the anode effect can be completely and quickly eliminated by remote control of the electrolytic cell. U.S. Pat. No. 3,539,461 and Japan Kokai Pat. Nos. 49-79308 and 54-148113 to Kokai involve the improvement mentioned above. In Japan Kokai Pat. No. 49-79308, the anode effect can be very effectively eliminated by first lifting and then lowering the anode, particularly in a multi-electrode cell with pre-baked anodes. However, in a single electrode cell with a self baking anode, gas below the anode lower surface occasionally may not be expelled satisfactorily. In such a case, the anode effect is eliminated but, shortly after the elimination, the anode effect is disadvantageously again generated. In addition, it is indispensable to operate a jack so as to lift or lower the anode, with the result that: the wear of the anode suspension mechanism, i.e. a so-called jack gear, is accelerated; and, further, considerable electric power is lost until the anode effect is eliminated over a rather long period of time.

OBJECTS AND SUMMARY OF THE INVENTION

It is an object of the present invention to provide a process for reducing the cell voltage and/or increasing the inter-electrode distance of an aluminum electrolytic cell with the self baking type electrode, thereby contributing to the reduction of the specific electric power consumption (P).

It is another object of the present invention to provide a process, in which, upon detection of the anode effect, the anode effect can be completely and reliably eliminated by the automatic operation of a simple device installed to each electrolytic cell, i.e. without manual operation.

It is a further object of the present invention to provide an aluminum electrolytic cell apparatus for carrying out the processes mentioned above, which apparatus being adapted to be automatic and to have a simple structure.

In accordance with the objects of the present invention, there is provided a process for the production of aluminum comprising the steps of:

forming in a cell body, an electrolytic bath, in which alumina is dissolved in a fused fluoride salt-bath mainly composed of cryolite;

conducting a current from a self-baking type carbon anode, which is located above the cell body, to the cell body serving also as a cathode, thereby simultaneously conducting the baking of unbaked carbonaceous raw material in the carbon anode and the electrolytic reduction of alumina;

maintaining the immersion of the carbon anode in the electrolytic bath on the molten aluminum which is formed in the cell as a result of the electrolysis;

feeding alumina in accordance with the decrease in the alumina concentration of the electrolytic bath; and, introducing a gas to the lower surface of the carbon anode being in contact with the electrolytic bath, via at least one aperture passing in an essentially vertical direction through the carbon anode.

An apparatus for the electrolytic production of aluminum according to the present invention comprises:

a cell body having an electrolytic bath and a molten aluminum serving as a cathode;

a tubular casing disposed above the opening of the cell body;

a self-baking type carbon anode located within the tubular casing and consisting of an upper unbaked layer and a lower baked layer;

electrically conductive spikes penetrated into the carbon anode vertically or laterally until these spikes arrive at the lower baked layer;

at least one aperture passing through the carbon anode essentially vertically, one end of each aperture being terminated at the upper surface of the upper unbaked layer and the other end being terminated at the lower surface of the lower baked layer; and, a compressed gas source communicated to the one end of at least one aperture via a conduit.

BRIEF DESCRIPTION OF THE DRAWINGS

The other objects of the present invention will be apparent from the following explanation of the prior art and the embodiments of the present invention in reference to the following drawings.

DISCLOSURE OF THE PREFERRED EMBODIMENTS

Figure 1:
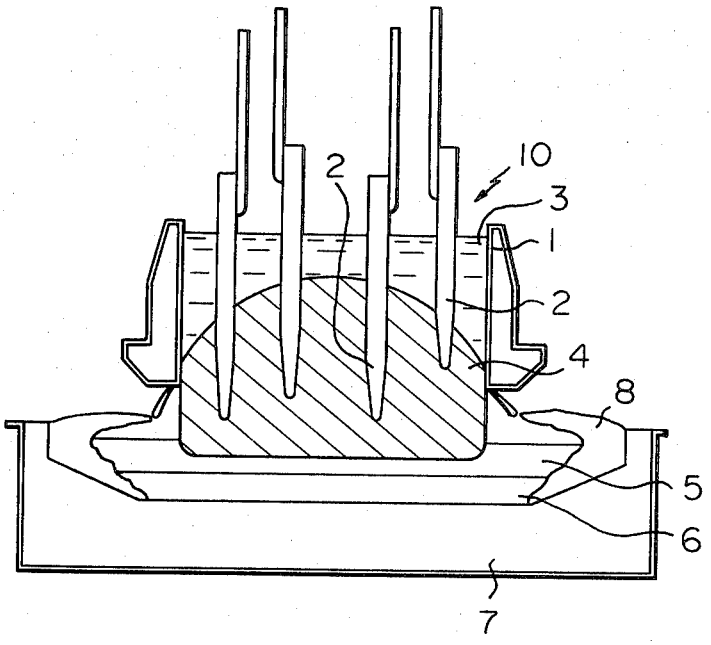
FIG. 1 is a vertical cross sectional view of a vertical type aluminum electrolytic cell with a self baking type carbon anode.

Referring to FIG. 1, the aluminum electrolytic cell is of a vertical type and is provided with a self-baking type carbon anode, which is frequently referred to as a Sodederberg electrode. However, the Sodederberg horizontal type cell can also be used in the present invention. In FIG. 1, the reference numerals indicate the following members of the electrolytic cell: 1—the casing of the anode; 2—the electrically conductive steel spikes; 3—the upper unbaked layer; 4—the lower baked layer; 5—the electrolytic bath; 6—molten aluminum which acts as a cathode from the view point of the electrolytic reaction; 7—the cell body; and, 8—the self lining. As above stated, the present invention makes it possible to operate the electrolytic cell while keeping the inter-electrode distance at a large value; and, to effectively and quickly eliminate the anode effect. Before describing how these objects are achieved, the phenomena induced in the electrolytic reduction as a result of the change in the alumina concentration is explained.

Figure 2:
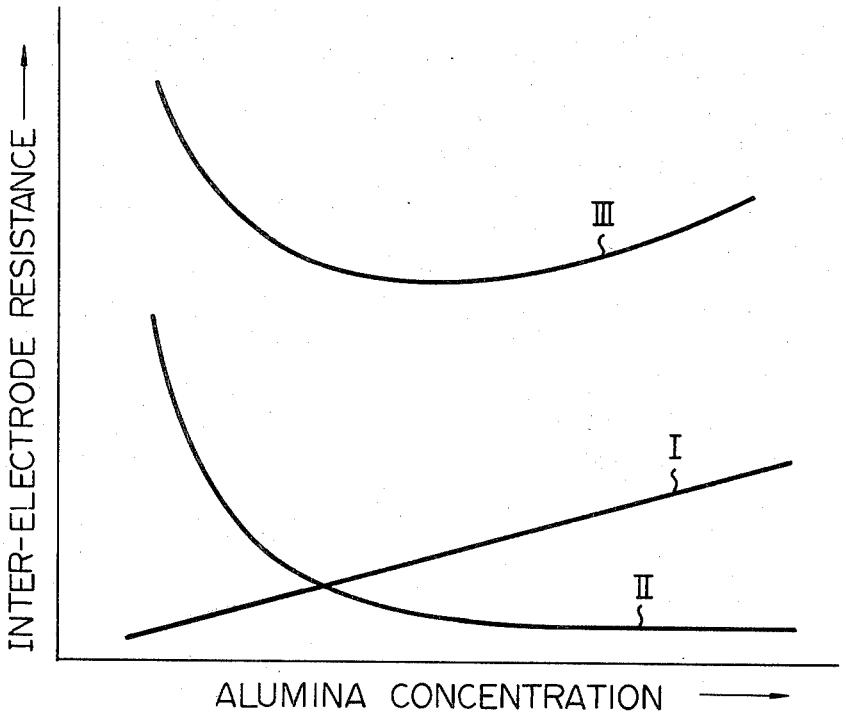
FIG. 2 is a graph indicating the relationship between the alumina concentration of the electrolytic bath and the inter-electrode resistance, wherein the symbols I, II and III indicate the electrolyte resistance, the gas film resistance and the total of the above mentioned two resistances, respectively.

Referring to FIG. 2, the alumina concentration is varied under the condition that the inter-electrode distance is kept constant. The inter-electrode resistance (curve III) indicated at the ordinate is the sum of the electrolyte resistance I and the gas film resistance II. The electrolyte resistance I is linearly increased in accordance with an increase in the alumina concentration which changes the electric conductivity of the electrolyte bath. On the other hand, the gas film resistance II is increased in accordance with the decrease in the alumina concentration, and the gas film resistance II is increased until the alumina concentration approaches the critical alumina concentration at which the anode effect is caused. When the inter-electrode voltage is constant, the increase in the gas film resistance must be compensated for by the decrease in the inter-electrode distance, and, thus, the electrolyte resistance, which results in a decrease in the current efficiency ($\eta$). Therefore, the measure explained hereinbelow for decreasing the gas film resistance ensures the formation of a large inter-electrode distance, thereby keeping the current efficiency ($\eta$) at a high level.

Figure 3:
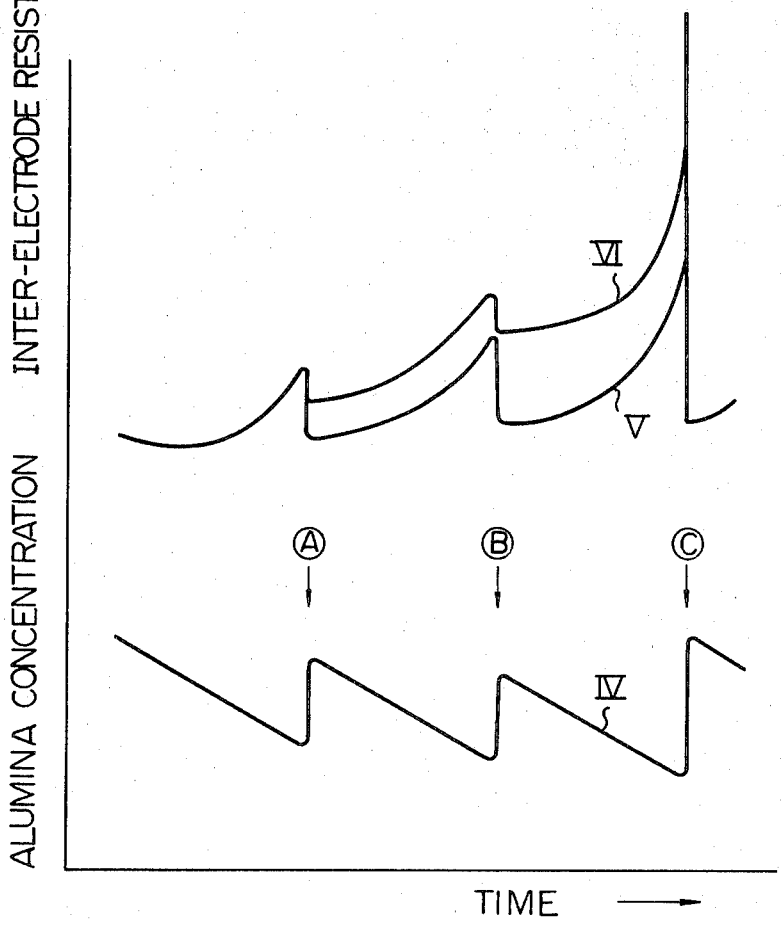
FIG. 3 shows the change of the inter-electrode resistance and the alumina concentration of the electrolytic bath with the lapse of time.

Referring to FIG. 3, the alumina concentration of the electrolyte bath is varied, as shown by the curve IV, during the operation of the electrolytic cell. The curve IV shows a typical change of in the alumina concentration of the electrolyte bath with lapse of time. The symbols A and B indicate that the alumina was fed or supplemented during the normal operation of the electrolyte cell, while the symbol C indicates that the alumina was supplemented when the anode effect was generated. The change in the alumina concentration IV causes a change of the inter-electrode resistance, and the latter change under the condition of constant inter-electrode distance is determined based on the curve III of FIG. 2. The so-obtained change of the inter-electrode resistance is shown by the curve V of FIG. 3. However, such a change as shown by the curve V is rarely observed during the conventional operation of the electrolytic cell, and the actual change of the inter-electrode resistance is shown by the curve VI. The curve VI, not the curve V, is observed during the conventional operation of the electrolytic bath, and this is believed to be due to the fact that the gas film resistance exhibits a hysteresis, i.e. the gas-film resistance increase, which is a result of the reduction in the alumina concentration, and which cannot be decreased or restored to the previous value by only restoring the alumina concentration.

As is already known, the wettability of the anode by the electrolyte bath deteriorates correspondingly to the increase in the gas-film resistance, and such deterioration is closely related to the amount of oxygen absorbed in the anode. The adsorbed oxygen cannot be removed satisfactorily by restoration of the alumina concentration in the electrolyte bath to the initial alumina concentration and, therefore, some mechanical agitation is necessary for removing the adsorbed oxygen.

The anode effect appears as an extreme increase of the gas film resistance and is believed to be caused by a poor wettability of the carbon anode and the electrolyte bath due to the decrease in the alumina concentration and by the formation of a highly insulating gas film between the carbon anode and the electrolyte bath, i.e. on the lower surface of the carbon anode. When such a film is formed, the normal electrolytic reaction is interrupted. In addition, when the highly insulating gas film is not removed for a long period of time, a large amount of electric power is consumed as the voltage drops in this film. Therefore, the anode effect must be eliminated promptly by any method other than the method of dissolving the alumina into the electrolyte bath and thus restoring the alumina concentration to the initial level.

According to widely used methods for promptly eliminating the anode effect, a long wooden bar capable of forming a large amount of gas by its thermal decomposition is inserted directly below the anode, the electrolyte bath is stirred using a jig directly below the anode, or a pressure gas is released from a conduit to the space between the anode and cathode. In these methods, it is necessary to break through a solidified layer of the electrolyte bath, hereinafter referred to as a crust, and then to commence the operation of eliminating the gas on the lower surface of the anode, which can be accomplished by the insertion of the wooden bar or by the introduction of gas. When the operators proceed to the electrolytic cell upon the generation of an anode effect, a considerable time has passed since the generation of the anode effect, with the result that the time required for eliminating the anode effect amounts to from three to ten minutes. When the anode effect is generated almost simultaneously in several of electrolytic cells, an additional rather long time is necessary for eliminating the anode effect in each of the electrolytic cells, and the electric energy consumed during the eliminating operation of the anode effect becomes disadvantageously high. It is not possible to overcome this disadvantage by the movable machine provided with a gas-blowing device proposed in U.S. Pat. No. 4,069,115.

The above described lifting and lowering method of anodes and a vibrating method of an anode proposed in British Pat. No. 853,056 are not satisfactory for eliminating the anode effect in the Soederberg type electrolytic cell.

The inventive concepts underlying this invention depend on the fact that compressed gas is blown to the bottom or lower surface of the anode; by this blowing, the gas film is removed from the lower surface of the carbon anode and the gas film resistance is decreased, while the alumina concentration of the electrolyte is higher than the critical alumina concentration and hence the anode effect is not generated (normal operation); and, by such removal of the gas film, the inter-electrode voltage is decreased at a given inter-electrode distance or the inter-electrode distance is increased at a given inter-electrode voltage. The developments mentioned above also involve the conception that, when the anode effect is generated, the anode effect can be easily eliminated by the removal of the gas film on the lower surface of the anode.

Figure 4:
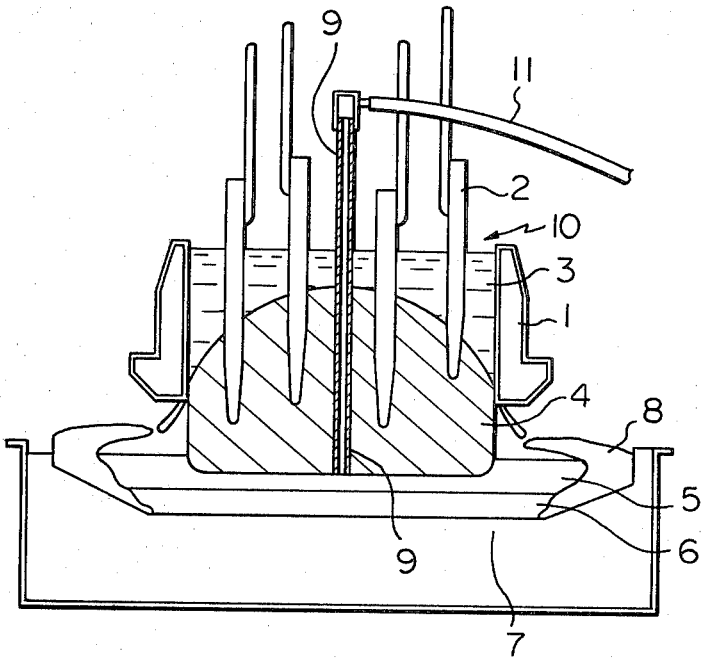
FIG. 4 is a view similar to FIG. 1 and illustrates an embodiment of the present invention.

Referring to FIG. 4 illustrating an apparatus according to an embodiment of the present invention, a vertical type electrolytic cell for the production of aluminum, with a self baking type anode is provided with an anode casing 1 which holds the carbon anode 10. The carbon anode 10 is gradually lowered with respect to the anode casing 1 in accordance with the development of the electrolytic operation. The carbon anode should therefore slide against the anode casing. The electrically conductive spikes 2 made of steel are penetrated or forced into the carbon anode 10 until these spikes arrive at the lower baked layer 4. The carbon anode 10 consists of the upper unbaked layer 3 and the lower baked layer 4 which is solidified. The cell body 7 is the receptable for the electrolyte bath 5 and the molten aluminum 6 formed as a result of the electrolytic deposition. The cell body 7 serves as both the receptacle and the cathode. The reference numeral 8 indicates the self lining. The aperture for introducing a gas below the anode surface is constituted by a gas-introduction tube 9 which which communicates with a pressure-gas source (not shown in FIG. 4) via a hose 11. The introduction of gas through the aperture in the carbon anode 10 has none of the disadvantages of the conventional methods for eliminating the anode effect, including those described hereinabove. In the conventional methods, a large amount of compressed gas is necessary for eliminating the anode effect, because the gas is not liable to extend over the entire lower surface of the carbon anode. In addition, the conventional tube used for injecting the gas is thermally deformed or worn out due to the erosion caused by the high temperature of the elecrolyte bath.

In an embodiment of the process according to the present invention, the introduction of gas from the aperture to the lower surface of the carbon anode is carried out intermittently during the normal operation of the electrolytic cell, i.e. at an alumina concentration higher than the critical alumina concentration, thereby achieving (a) the reduction of the cell voltage at a given inter-electrode distance or (b) the increase of the inter-electrode distance at a given cell voltage.

The introduction of gas is effective for cleaning the lower surface of the carbon anode. This is not only effective for the above described removal of the gas film, but also for the removal of carbon powder or pieces. Portions of carbonaceous material of the carbon electrode, which do not react with the oxygen of the alumina, float on the electrolyte bath level and are deposited on the lower surface of the carbon electrode as carbon powder or pieces which contaminate said lower surface of the elecrode. The carbon powder or pieces are expelled from the lower surface of the carbon electrode by the introduced gas and this is highly effective for the cleaning of said lower surface.

With regard to the time of blowing a gas during the normal operation of the elecrolytic cell, the gas is preferably blown through at least one aperture of the carbon electrode when the alumina is fed into the electrolytic cell. It is possible by such blowing to realize the change of the inter-electrode resistance with the lapse of time essentially coincident with the curve V of FIG. 3.

With regard to the kind of gas blown, in accordance with the process of the present invention, air or nitrogen can be used, and the oxidation of the molten aluminum by the air is negligible because even a small amount of air is effective for cleaning the lower surface of the carbon anode. However, a non-oxidizing gas, for example nitrogen, is obviously preferable.

The gas should be blown at least 5 $l/m^2$ of the anode area over 3 seconds, however, the minimum gas rate is preferably 7 $l/m^2$, thereby ensuring the elimination of the anode effect. The maximum blowing rate is not specifically limited but is determined from the view point of balance of the effect of anode effect elimination and the amount of gas used. The gas is blown preferably twice for the purpose of the anode effect elimination, over a period of a few seconds, for example 3 seconds, at a rate which falls within the ranges mentioned above. The time period between the two blowing periods is preferably 30 seconds.

In an embodiment of the process according to the present invention, the gas is blown through the at least one aperture of the carbon anode and introduced to the lower surface of the carbon anode upon the generation of the anode effect.

The aperture of the present invention may be any aperture or a through hole of the carbon electrode suitable for the introduction of gas to the lower surface of the carbon anode. Usually, the aperture is defined as a tubular conduit passing through the carbon anode. This tubular conduit may be lowered, together with the carbon anode, in accordance with the consumption of the carbon anode. The consumption rate or height of the carbon anode amounts to from about 15 to 20 mm per day at the current density of 0.7 $A/cm^2$. The function of the tubular conduit for introducing the gas can be realized even during the consumption of the carbon electrode, when the tubular conduit is dissolved into the electrolyte bath or electrolyzed at a rate substantially equal to the consumption rate of the carbon electrode. For the material of the tubular conduit, a relatively non-noble metal, such as iron, aluminum and copper, or a carbonaceous material, is appropriate. These metals, other than aluminum, contaminate the aluminum product only to a negligible extent.

The present inventors discovered that, if the electrolyte is allowed to ascend into the tubular conduit, the electrolyte is solidified in the tubular conduit. The lower baking layer, which surrounds the tubular conduit, cannot keep electrolyte fused in the tubular conduit, and the temperature gradient in the vertical direction of the tubular conduit causes the electrolyte to solidify. The solidified electrolyte causes plugging of the tubular conduit. Such plugging can, however, be prevented, when the gas pressure is constantly applied to the electrolyte within the tubular conduit at a pressure practically equal to the hydrostatic pressure at the immersion depth of the carbon electrode into the electrolyte bath. This pressure should be between the minimum pressure, at which the electrolyte is forced downward to a position in the tubular conduit where the elecrolyte is not solidified, and the maximum pressure, at which the gas does not flow out of the tubular conduit. In order to establish the pressure for preventing the solidification of the electrolyte within the tubular conduit, the gas source may be cut from communication with the tubular conduit by means of a valve after the pressure gas is blown through the tubular conduit to the lower surface of the carbon anode. When the communication between the gas source and the tubular conduit is stopped, the gas already supplied from the gas source to the tubular conduit creates the pressure. The thus established gas pressure is higher than the atmospheric pressure and is applied to the upper surface of the electrolyte admitted into the tubular conduit, with the result that the electrolyte height in the tubular conduit is lower than that height which causes the solidification. Incidentally, if it is necessary to relieve the internal pressure of the tubular conduit, because of, for example, securing an additional tubular conduit on the existent tubular conduit, the electrolyte may ascend into the tubular conduit and then solidify. When the pressure relieving period is relatively short, the solidified electrolyte is soft and thus can be easily broken by the pressure of the compressed gas. Therefore, the tubular conduit again can act as the means for introducing the gas.

In the present invention, the number of aperture(s) or tubular conduit(s) in a single carbon electrode is not specifically limited. One aperture is sufficient for the single self baked type carbon anode of an electrolytic cell having a current capacity of 100 KA. However, in order that the lower surface of the carbon anode be cleaned by a considerably small amount of gas, a plurality of apertures at various locations can be used optionally. An example is to locate, in addition to one central aperture, additional apertures at each of the short sides of the carbon electrode. When an electrolytic cell is designed having a number of aperture(s) at a predetermifned position, the electrolytic cell is operated with the number of aperture(s) at this predetermined position. The tubular conduit(s) may be preliminarily forced through the carbon anode prior to the operation of the electrolytic cell. Alternately, the tubular conduit(s) may be forced from above into the non-baked layer of the carbon anode, subsequent to the initiation of the cell operation. This conduit(s) is lowered to the unbaked layer of the carbon anode in accordance with the lowering movement of the carbon anode. The penetration of the tubular conduit through the carbon anode can be accomplished by the anode lowering movement indispensable in the operation of the cell. During the lowering movement of the tubular conduit(s), together with the lowering movement of the carbon anode, the tubular conduit is dissolved in the electrolyte bath. However, the tubular conduit(s) does not dissolve when the tubular conduit(s) slides against the carbon surface around the aperture at a rate commensurate with the height of anode consumption.

Methods for preventing the erosion of a tubular conduit are explained with reference to FIG. 4.

The carbon anode 4 of the vertical type electrolytic cell slides against the anode casing 1 and descends with the development of the electrolytic reaction. The electrically conductive spikes 2 also descend together with the carbon anode 4 but are periodically, pulled up by a spike puller, before they reach the electrolyte bath. The tubular conduit 9 can also be pulled up periodically by the spike puller.

A material, such as stainless steel, which exhibits, when subjected to sintering with carbon, a relatively low bonding strength, may be used for the tubular conduit 9, and the tubular conduit 9 is fixed to a holder (not shown in FIG. 4) installed above the electrolytic cell. Therefore, when the carbon anode 10 descends, the tubular conduit 9 slides with respect to the carbon anode 10 in such a manner its position is not changed regardless of the lowering movement of the carbon anode 10.

As described above, the lowering movements of the carbon anode 10 and tubular conduit 9 may occur simultaneously. During the lowering movements, the tubular conduit 9 is constantly in contact with the electrolyte bath and is thus dissolved in or consumed by the electrolyte bath. The raw materials of the carbon electrode are piled on the carbon electrode in proportion to the lowering movement or consumption of the carbon electrode. When the height of the piled raw materials exceed the top end of the tubular conduit, a new tube having an appropriate length is prepared above the carbon electrode and is then connected to the tubular conduit 9 in the carbon anode 10.

Figure 5:
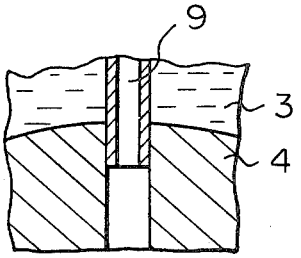
FIG. 5 is a partial cross sectional view of an anode and illustrates how a tube is slid into the carbon anode.

Referring to FIG. 5, showing a partial cross sectional structure of the carbon anode, the aperture for the introduction of gas comprises the tubular conduit 9 at the upper part thereof and the aperture defined by the wall of the carbon anode 4 at the lower part thereof. The sliding or pulling movement of the tubular conduit 9 is carried out in such a manner that the wall of the carbon anode defines the aperture for the introduction of the gas. The lower end of the tubular conduit 9 is not in contact with the electrolytic bath.

The tubular conduit(s) may have any cross sectional shape, such as a cylindrical or rectangular shape. However, when the tubular conduit(s) is to be pulled up, the tubular conduit(s) is preferably of a cylindrical cross sectional shape, so that, before the pulling up of the tubular conduit(s), they can be revolved so as to separate the conduit(s) sintered to the carbon anode from the carbon anode.

Advantageously, the anode effect can be automatically eliminated in the present invention. This can be very easily accomplished by detecting the generation of the anode effect, readily operating an automatic adjusting device, such as a magnetic valve, interlocked to the anode effect detecting means, and then feeding a small amount of the compressed gas from the gas source to the tubular conduit. The alumina may be fed or supplemented to the electrolyte bath almost at the same time as the feeding of the compressed air. This is very effective for the elimination of the anode effect, because the anode effect is generated when the alumina concentration of the electrolyte bath is considerably lower than that directly after feeding of the alumina.

In an electrolyte cell, in which the alumina is automatically fed by means of an air cylinder or the like actuated by a compressed air, the operation for eliminating the anode effect can be carried out as follows. Namely, upon the generation of the anode effect, the compressed air at the exhaust side of an air cylinder is admitted into the aperture of the present invention, and feed of alumina and the introduction of gas to the lower surface of the carbon anode are interlocked, which is an efficient and economic operation for eliminating the anode effect.

Also advantageously, the anode effect can be eliminated more reliably and in a shorter time as compared with the conventional processes. This is because the introduction of gas can be realized at the center of the carbon electrode or an optical position of the carbon anode where the aperture(s) can be formed.

Figure 6:
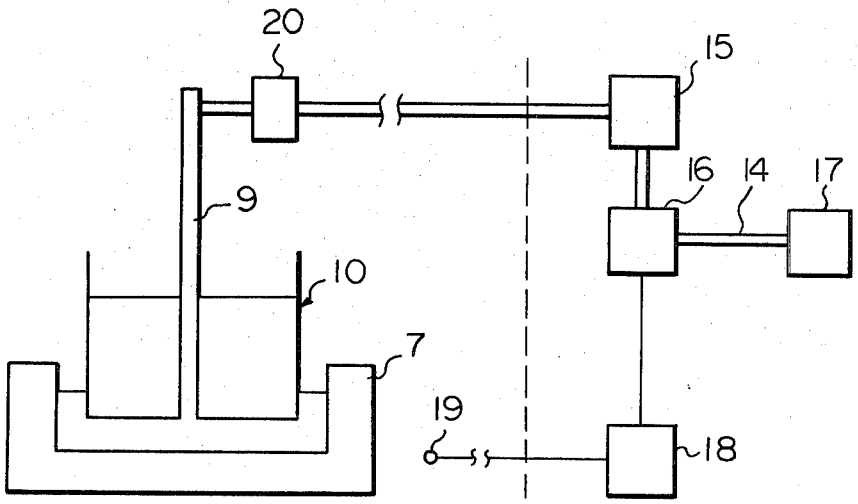
FIG. 6 is a diagram illustrating the automatic elimination of the anode effect according to an embodiment of the present invention.

Referring to FIG. 6, a method for automatically eliminating the anode effect by remote control is illustrated. The system for automatically eliminating the anode effect shown in FIG. 6 comprises: a means for detecting or anticipating the generation of the anode effect; and a valve means electrically connected to the detecting or anticipating means, wherein the gas source is communicated to at least one aperture of the carbon anode via the valve means and a conduit. This system may be controlled by a known computer system for controlling the cell voltage and feed of the alumina, i.e. one of the raw materials in the aluminum production, thereby enhancing the efficiency of the automatic operation of an electrolytic cell.

The detecting or anticipating means of the anode effect comprises a measuring device or terminal 19 of the cell voltage or the composition of anode gas, and the signal generated in accordance with the variance of the cell voltage and the anode gas composition is transmitted from the measuring device or terminal 19 to the detector 18. The detector 18 can compare the measured and predetermined values of the cell voltage or the anode gas composition and then determine whether the anode effect has been generated or is about to occur. Upon such determination, the magnetic valve 16 installed at the gas source 17 and the magnetic valve 20 installed at the electrolytic cell are opened for a predetermined period of time. Compressed air or nitrogen in the gas source 17 is then injected from the gas source to the lower surface of the carbon anode via a conveying tube 14, a pressure gauge 15 and the tubular conduit passing through the carbon anode. As a result of the introduction of gas, the anode effect is eliminated. The pressure of the gas introduced to the lower surface of the carbon anode may be the total pressure of the gas source minus the pressure drop in the tube system between the gas source and the end of the tubular conduit. This pressure may also be a controlled injection pressure ($V_1$) which is adjusted by a pressure-adjust valve (not shown in FIG. 6) controlled by a computer. In this case, the magnetic valves 16 and 20 may be connected and the closing time of the magnetic valves 16 and 20 is controlled by an connecting mechanism whereby the normal pressure ($V_2$) constantly applied to the electrolyte in the tubular conduit(s) is lower than the injection pressure ($V_1$), i.e. $V_1 > V_2$.

The members 14, 15, 16, 17 and 18 of the system for automatically eliminating anode effect are installed commonly with respect to all of the electrolytic cells and are operated to control these cells under a centralized control system. These members can be controlled by the computer of the electrolytic cells.

The magnetic valve 20 should be located as closely as possible to the electrolytic cell, because this location is desirable for establishing normal pressure ($V_2$).

The gas may continue to be introduced until the elimination of the anode effect is determined by the detector 18 and the measuring device or terminal 19. However, the elimination of the anode effect can usually be achieved as desired by introducing the gas having a predetermined pressure over a predetermined period of time.

The present invention is explained hereinafter by way of examples.

EXAMPLE 1

The electrolytic cell was provided with a vertical self baking type anode, had a current capacity of 100 kA and was controlled by an input control system so that the cell voltage was maintained at a constant voltage. A tubular conduit was positioned at the center of and through the carbon electrode. Compressed air was blown through the tubular conduit to the lower surface of the carbon anode every four hours, when the alumina was fed to the electrolyte bath. The amount of the blown air was about 100 normal liter (at a normal temperature and a normal pressure) over a period of about 4 seconds at each blowing time. The following table shows the current efficiency average value of one year with respect to the process explained above and a conventional process.

| Process | Current Efficiency ($\eta$) |
|---|---|
| Conventional Process | 89.0% |
| Present Invention | 91.2% |

EXAMPLE 2

The electrolytic cell was provided with a self baking type anode and was of a vertical type and had a current capacity of 100 kA. A tubular conduit was made of a steel tube having an outer diameter of 27.2 mm, an inner diameter of 21.6 mm and a length of 2.2 m and was positioned at the center of, and through, the carbon anode. The tubular conduit was connected via a valve to the source of compressed air of 7.5 atm. The tubular conduit was lowered at a rate of about 15 mm per day, and a 0.9 m long steel tube having the same cross sectional dimension as that of the above steel tube was connected, once per sixty days, to the tubular conduit being lowered.

When the anode effect was generated, about 100 normal liters (corresponding to 7 $l/m^2$ of the anode area at a normal pressure and temperature) of air were introduced to the lower surface of the carbon anode twice over a period of about 3 seconds each time and at intervals of 30 seconds. The anode effect could be completely eliminated by such introduction of the air.

We claim:

1. A process for the production of aluminum comprising the steps of:

forming in a cell body an electrolytic bath in which alumina is dissolved in a fused fluoride salt bath mainly composed of cryolite;

conducting a current from a self-baking type carbon anode, which is located above said cell body, to said cell body serving also as a cathode, thereby simultaneously conducting the baking of unbaked carbonaceous raw material in the carbon anode and the electrolytic reduction of alumina;

maintaining the immersion of said carbon anode in the electrolytic bath above the molten aluminum which is formed on the cell body as a result of electrolysis;

feeding alumina in accordance with the decrease in the alumina concentration of the electrolytic bath;

introducing a gas to the lower surface of said carbon anode which is in contact with the electrolytic bath via at least one aperture passing in an essentially vertical direction through the carbon anode; and intermittently introducing the gas from said at least one aperture to the lower surface of the carbon anode during normal operation of the cell when the alumina concentration is higher than a critical alumina concentration so that an anode effect is not generated, thereby reducing the cell voltage or increasing the inter-electrode distance of an aluminum electrolytic cell.

2. A process according to claim 1, wherein said gas is nitrogen or air.

3. A process according to claim 1, wherein the gas pressure is constantly applied to the electrolyte within said at least one aperture at such a pressure as to prevent the solidification of the electrolyte within said at least one aperture and the gas is intermittently introduced to said lower surface of the carbon electrode.

4. A process according to claim 3, wherein the constantly applied pressure is practically equal to the hydrostatic pressure at the immersion depth of the carbon electrode to the electrolyte bath.

5. A process according to claim 1, wherein a tubular conduit defining said at least one aperture is periodically pulled up.

6. A process according to claim 5, wherein the lower end of the tubular conduit is held at such a level as not to contact the electrolytic bath.

7. A process according to claim 1, wherein the alumina is fed to the electrolyte bath at almost the same time as the introduction of the gas.

8. A process according to claim 1, wherein said at least one aperture is defined as a tubular conduit passing through said carbon anode, and said tubular conduit is lowered together with said carbon anode, and the lower end of said tubular conduit held at the end of said carbon electrode is consumed in accordance with the consumption of the carbon anode.

9. A process according to claim 8, wherein the material of said tubular conduit is one selected from the group consisting of iron, aluminum and copper, and a carbonaceous material.

10. A process according to claim 1, wherein the gas pressure is constantly applied to the electrolyte within said at least one aperture at such a pressure as to prevent the solidification of the electrolyte within said at least one aperture and the gas is intermittently introduced to said lower surface of the carbon electrode, and the alumina is fed to the electrolyte bath at almost the same time as the introduction of the gas.

11. A process according to claim 10, wherein said gas passes through said anode electrode from one end thereof directly to the outermost tip of the other end.

12. A process according to claim 1, wherein said at least one aperture is defined as a tubular conduit passing completely through said carbon anode from one end at the top thereof through to the lower end thereof, and said tubular conduit is lowered together with said carbon anode, and the lower end of said tubular conduit held at the end of said carbon electrode is consumed in accordance with the consumption of the carbon anode, and the tubular conduit defining said at least one aperture is periodically pulled up.

13. The process of claim 1, wherein said gas is blown at a rate of at least 5 $l/m^2$ of the anode area to the lower surface of the anode to prevent the anode effect.

14. The process of claim 13, wherein said rate is 7 $l/m^2$ of the anode area.

15. The process of claim 13, wherein said gas is blown twice over a period of a few seconds with an interval of about 30 seconds between blowing periods.

* * * * *